US006829840B1

(12) United States Patent
Stone

(10) Patent No.: US 6,829,840 B1
(45) Date of Patent: Dec. 14, 2004

(54) CIRCULAR VIBRATORY FLUID BED DRYER

(75) Inventor: Lawrence H. Stone, Rivervale, NJ (US)

(73) Assignee: Kason Corporation, Millburn, NJ (US)

( * ) Notice: Subject to any disclaimer, the term of this patent is extended or adjusted under 35 U.S.C. 154(b) by 0 days.

(21) Appl. No.: 10/834,140

(22) Filed: Apr. 29, 2004

(51) Int. Cl.[7] ..... F26B 7/00

(52) U.S. Cl. ..... 34/164; 34/167; 34/168; 209/22

(58) Field of Search ..... 34/147, 164, 166, 34/167, 168; 209/21, 22; 425/22

(56) References Cited

U.S. PATENT DOCUMENTS

| | | | | | |
|---|---|---|---|---|---|
| 3,767,419 | A | * | 10/1973 | Sienkiewicz et al. | 426/595 |
| 4,064,638 | A | * | 12/1977 | Stanfield | 34/174 |
| 5,632,097 | A | * | 5/1997 | Snitchler et al. | 34/61 |
| 6,035,543 | A | * | 3/2000 | Carlyle | 34/164 |
| 6,216,875 | B1 | * | 4/2001 | Stone | 209/22 |

FOREIGN PATENT DOCUMENTS

| | | | | |
|---|---|---|---|---|
| SU | 606064 | * | 4/1978 | B01J/8/40 |
| WO | WO 97/27766 | * | 8/1997 | A24B/3/04 |

* cited by examiner

*Primary Examiner*—Stephen Gravini
(74) *Attorney, Agent, or Firm*—Stanley J. Yavner

(57) ABSTRACT

A two-deck apparatus, one deck above the other, is provided for enabling drying of approximately twice as much material with very little increase in heat used to dry the material, when compared to a single deck dryer. The fan usually provided with dryers of this type requires only a small incremental size increase over prior art. The second or upper deck, in operation, experiences a greater pressure below that deck than the pressure above the deck. Solid material flows into the top of the apparatus from above, and then from the upper deck to the lower deck through what is essentially a one-way valve, with air flow moving from below the lower deck through the upper deck, without impeding the material flow downwardly in the apparatus. The same apparatus, but with the use of cold air to cool the product, rather than hot air to heat and dry a product, is also within the teachings of the present invention.

4 Claims, 2 Drawing Sheets

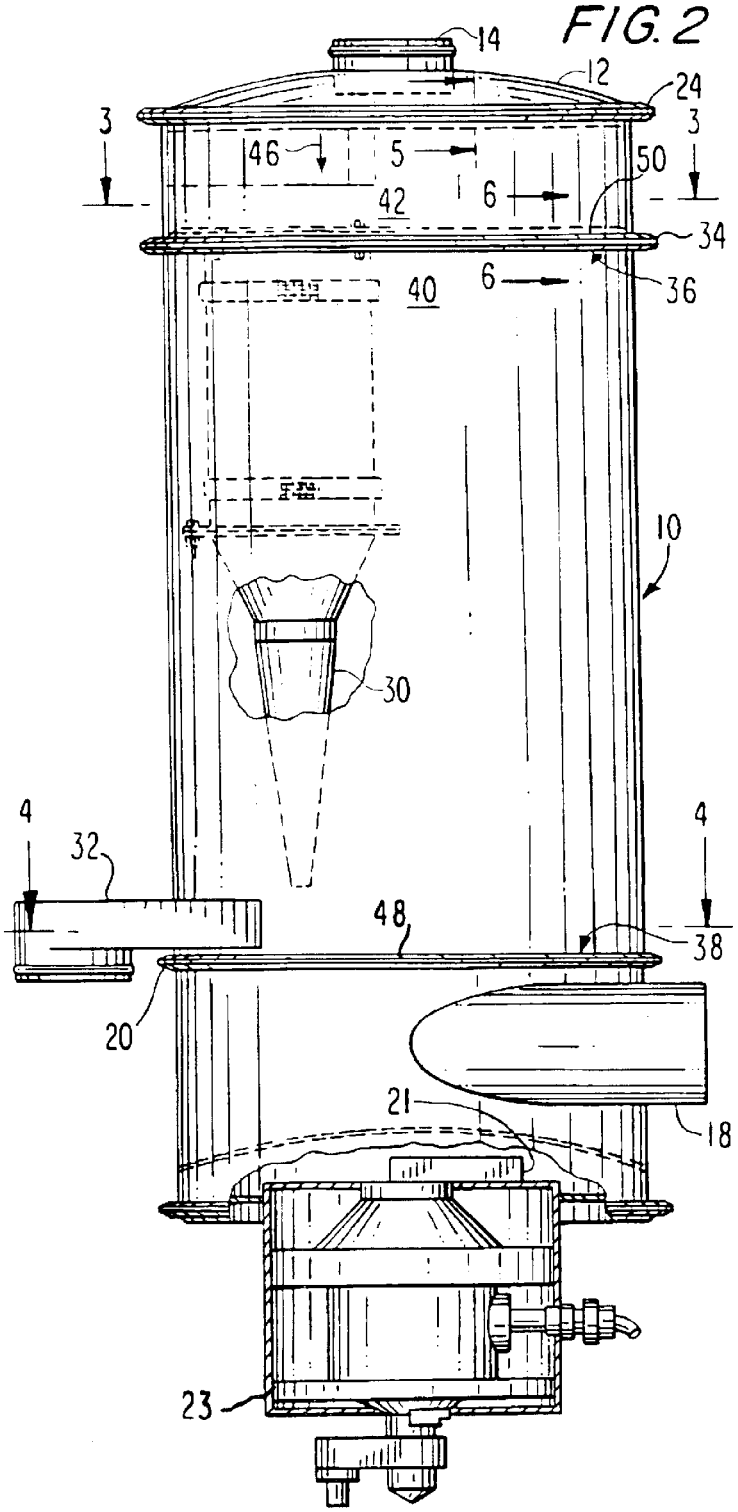
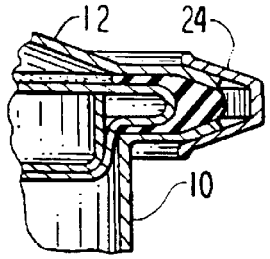
FIG. 5
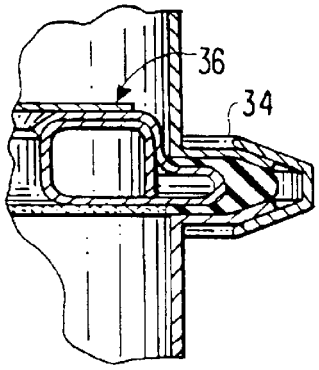
FIG. 6

CIRCULAR VIBRATORY FLUID BED DRYER

FIELD OF THE INVENTION

This invention relates primarily to circular vibratory fluid bed processors typically used for heating and drying or cooling particulate food materials, or the like.

BACKGROUND OF THE INVENTION

In a typical, prior art circular vibratory fluid bed dryer, air is taken from the outside and heated while material to be dried is introduced to the apparatus. Hot air is brought up through the bed or deck, where the material is vibrating, fluidizing the material to be dried, so that there is intimate contact between the hot air and moist product. The heated air drives off the moisture and the dry product moves to an exit where it is discharged. The energy requirements for such a process are not necessarily governed by what is needed to drive off moisture from the material; the requirements instead are governed by the amount of heat required to heat the amount of incoming air, which is required for fluidization of the moving particals on the vibrating bed. A great deal of heat can be wasted in the exhaust air.

It would be a significant improvement in the above generally described state-of-the-art if, in the same footprint, a significant increase in materials processed would be enabled by using a multi-deck system, herein described as a two-deck system, but not necessarily limited to two decks.

A similar improvement would result from a multi-deck system with only a small increase in the size of the fan used typically in apparatus to move the air for drying or cooling food materials, pharmaceuticals, chemicals or other products. Still further, in a multi-deck system, there is only a slight increase in the amount of heat that would be required since the volumetric air flow is essentially the same for single and multi-deck processing; hence less energy is required per pound of product processed in a two deck unit used to dry approximately twice as much material. Additionally, materials dried in the present invention two-deck system travel in the processing from the upper deck to the lower deck; and air moves from below the lower deck, through the lower deck and then upwardly through the upper deck. A one-way valve and structure is used to carry the material, partially dried, from the upper deck downwardly to the lower deck for completion of the drying and the output of the dried materials.

The prior art fluid bed dryers in existence today, use more energy for amount of material processed and require larger capacity air flow per square foot of drier bed fluidization than is required in a multi-deck unit, which uses the same air velocity for fluidization and heat transfer. Also, if the prior art fluid bed dryers do have multi-decks, they are not vibratory, and therefore, the particles are dependent solely on the upward air velocity for fluidization and hence greater air flows, more heat and thereby more energy to accomplish their processes.

OBJECTS AND SUMMARY OF THE INVENTION

Accordingly, a primary object of the present invention is to provide a circular vibratory fluid bed dryer with two or more decks, for efficiency of energy required for air and heat and for efficiency in processing higher production rates within the same footprint.

A further object is to provide a circular vibratory fluid processor for drying or cooling, which is more efficient than single bed dryers or coolers, or than double bed dryers or coolers, which do not use vibration.

These and other objects of the present invention are provided in a circular vibratory fluid bed dryer which features a pair of decks located in the space between the air intake port and the material inlet port located at the top of the apparatus, adjacent to the air outlet port. The apparatus elements are located in such a way, and with the friction of the air going through the very small apertures defined by the upper deck itself, to create a pressure drop from below the upper deck to above the upper deck. The pressure drop enables the use of a one way valve to carry the material from above the upper deck to the lower deck, thereby to prevent the air flowing upwardly from blocking the downflow of material in the apparatus and bypassing the upper deck. The input of material from above the upper deck is of partly dry material, which gives up moisture to the air above the top deck to the process of fluidization and the heat transfer between the vertically rising heated air flow being in intimate contact with moisture laden particles. Completion of the drying is on the lower deck.

As the air inlet provides heated air below the lower deck, and vibration of the entire apparatus causes the material particles to commence movement and thus require less air to accomplish fluidization, the thermal efficiency of the drying apparatus is increased.

Similarly, a cooling system is enabled by the same apparatus.

BRIEF DESCRIPTION OF THE DRAWINGS

Other objects, features and advantages of the invention will become apparent by the following more detailed description of a preferred, but nonetheless illustrative, embodiment of the present invention with references to the accompanying drawings, wherein:

FIG. 2 is an elevational view, showing a representation of the external vibration motor, with various inlet openings and output openings defined by the apparatus housing, as well as the one-way valve mechanism connecting the material flow downwardly from above the upper deck to the lower deck;

FIG. 5 is a sectional view of the apparatus, taken along the line 5—5 of FIG. 2, showing particularly the upper dome connection to the cylindrical housing for the apparatus; and FIG. 6 is a sectional view, taken along the line 6—6 of FIG. 2 and showing particularly a cross-section of the upper deck and its connection with the cylindrical housing of the apparatus.

DETAILED DESCRIPTION OF THE PREFERRED EMBODIMENT

Figure 1:
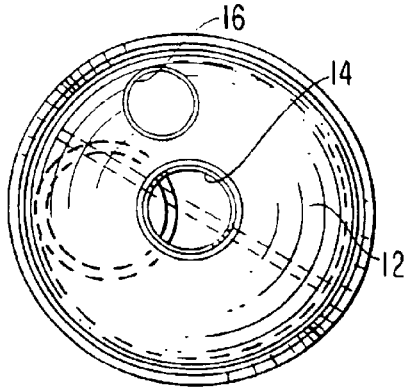
FIG. 1 is a top view of apparatus according to the present invention.

Referring to FIG. 2, a cylindrical housing generally designated 10 for the apparatus is covered by dome 12, defining air output port 14. Also defined by the dome, as shown in FIG. 1, is a material inlet port 16 into which powder material is provided for heating and drying by means of air intake element 18 for externally heated or cooled air.

Vibration is imparted to the entire apparatus by means of the motor 23, as well as by use of unbalanced eccentric weights 21 fastened to the motor shaft extensions. This method of vibration is shown for illustrative purposes only. Of course, other methods of vibration are likewise useful.

Dome 12 defines air output port 14 and is attached to cylindrical housing 10 by means of connection 24 shown in FIG. 5.

Just above lower screen deck 38 is located dry powder outlet element 32, as shown in FIG. 2.

FIG. 2 illustrates a two-deck vibrating fluid bed dryer, upper deck 36, having screen 50 on mounting element 34, and lower deck 38, having screen 48 and mounting element 20. The pressure below the lower deck is higher than the pressure above the lower deck, which is higher than the pressure above the upper deck 36, having a screen 50 and defining very small appertures. The temperature of the incoming air below the lower deck 38, with its screen 48, is higher than the temperature of the air just below the upper deck as the air has already transferred some of its heat to complete the drying process on the lower deck. The air passing through the upper deck transfers additional heat to the solids on the upper deck commencing the drying process and partially drying the product. The passage of air and solids is a counter current operation. The material flow 46 of the entering products flow in a clockwise spiral or clockwise circular path as it is partially dried, and then goes into and through one-way valve element 30. The lower part of one-way valve element 30 operates in closed position by means of the external pressure on the flexible member being greater than the internal pressure above the upper deck. This valve stays closed until enough solids collect above the lower part of element 30 (the pinch point) to force it open due to the weight of the solids. When enough solids collect above the pinch point so that the weight of the solids overcome the closing force due to the differential pressure above and below the upper deck, the valve located at that point opens until the pressure differential takes over again and the cycle is repeated. Such a one-way valve element 30, for example, is sold under the mark DUSTEX and under the model number 112 VV by Dustex Corporation of Charlotte, N.C.

Figure 4:
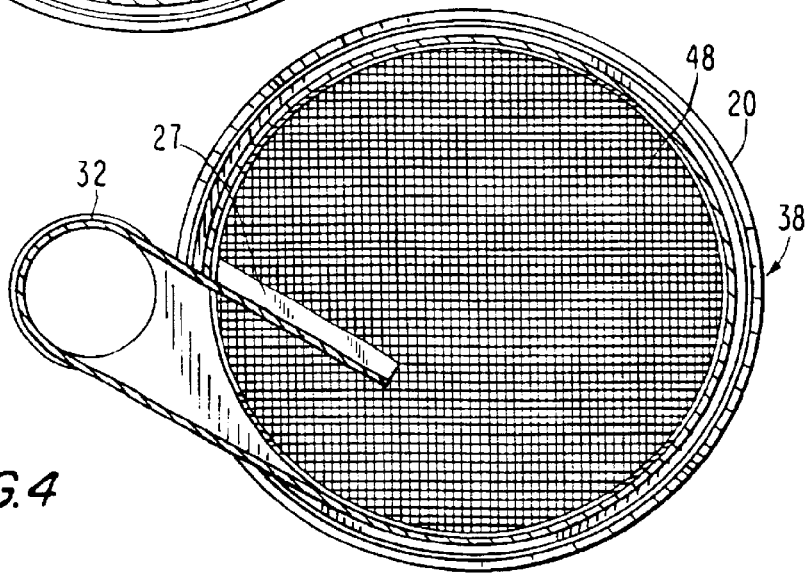
FIG. 4 is a sectional view of the apparatus of FIG. 2, taken along the line 4—4, and showing particularly the lower deck of the apparatus and the dry powder output element for the material, and also showing a second baffle to prevent the material from the upper deck from short-circuiting to the discharge spout.

FIGS. 6 and 2 show, respectively, the upper deck 36 mounting element 34 and its location in the apparatus. FIGS. 4 and 2 show, respectively, the lower deck, generally designated 38, and its position in the apparatus.

Figure 3:
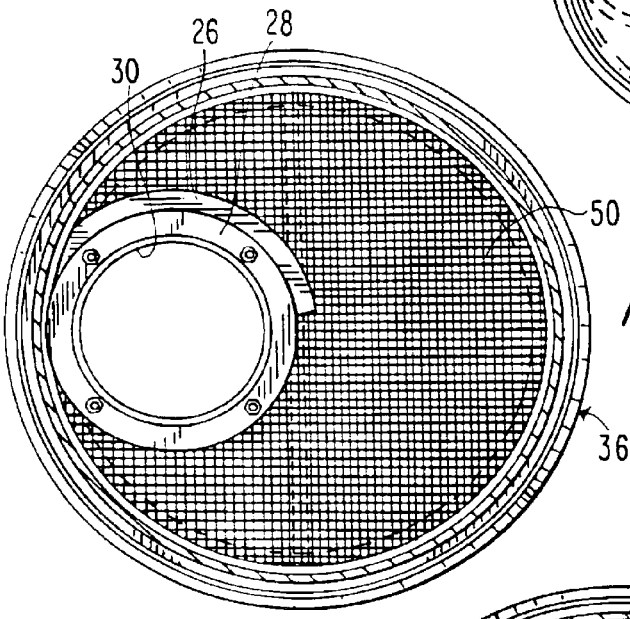
FIG. 3 is a sectional view, taken along the line 3—3 of FIG. 2, and showing particularly the upper deck and the mounting thereon of the one-way valve element and the location of a first baffle to prevent fresh moist feed from short-circuiting into the one-way valve. That baffle also prevents partially dry material from bypassing the entrance to the one-way valve.

In FIG. 3 particularly, the mounting 28 of the one-way valve element 30 in upper deck 36 is shown; and FIG. 4 shows the dry powdered material output 32. Baffle 26 is also shown in order to prevent short-circuiting of material down the one-way valve 30. FIG. 3 also illustrates a typical perforated plate or screen mesh 50 in upper deck 36 for creating friction as air passes upwardly therethrough. The fine holes or apertures in the deck screen 50 are for the purpose of distributing the air uniformly across the area of the deck. The flow of air through the tiny holes or apertures or orifices creates a pressure drop between the area 40 below the upper deck 36 and the area 42 above the upper deck 36. In other words, the area 40 below the upper deck is of a higher pressure than the area 42 above the upper deck; so that when air flows upwardly, the higher temperature air will be contacting the material flow represented by arrow 46 in FIG. 2, for purposes of heating and drying in area 42. Material flow 46 circulates in a clockwise direction on screen 50, around a first baffle 26, and then flows unabated into and through one-way valve element 30. The lower part of one-way valve element 30 operates, by means of the pressure differential in the system, to stay closed until enough solids collect above that lower part of element 30 (the pinch point). If enough solids collect above the pinch point, the valve located at that point opens until the pressure differential takes over again and the cycle is repeated. Such a one-way valve element 30, for example, is made under the mark DUSTEX under the model number 112 VV by Dustex Corporation of Charlotte, N.C.

A second baffle 27 is arranged on the lower screen proximate dry powder outlet element 32. Baffle 27 prevents short-circuiting of material from the upper deck, as it discharges from one-way valve 30. On lower deck screen 48, dried material flows in a clockwise direction, so that it flows around second baffle 27 and then to outlet element 32.

In order to provide a more complete description of the present invention, a series of operational steps is now provided, with particulate powder product to be dried being the material flow 46 as an input through opening 16 defined by the dome 12 of the apparatus. As material flow 46 comes through opening 16, the material comes into contact with externally heated air flowing up through lower deck screen 48, housed in lower deck generally designated 38. The heated air flows upwardly through deck 38 and then through screen 50 of upper deck 36 to contact the flow 46 of moist powder product to be dried. The heated air reduces the moisture of the powder product as it flows in a clockwise direction around first baffle 26. Since the moist inlet product moves counter-current to the air flow, the most difficult part of the drying process, the diffusion of the final residual moisture, the product is then in contact with the highest air temperature, resulting in very efficient drying. The heated air in lower pressure area 42 partially dries the powder material, with the process better enabled by the vibration of the apparatus. The drying takes place across both the upper and lower decks, using the same vibrational energy to commence fluidization and essentially the same superficial air velocity for true intimate contact between the drying air and the product to be dried. Heated and dried material flow 46 then flows through one-way valve element 30 down to the area above lower deck 38, clockwise on lower deck screen 48, around second baffle 27, and then out through output element 32.

The foregoing provides a complete description of a circular vibratory fluid bed dryer according the present invention, but its scope of protection is to be limited only by the following claims.

What is claimed is:

1. A vibratory fluid bed dryer apparatus having a housing with upper and lower ends, and a mechanism for vibrating said apparatus, comprising a dry powder outlet element, an air intake element defined by the housing and proximate the lower end thereof for enabling the entry of heated air, a material inlet port defined by the upper end of said housing, an air outlet port defined by said housing and proximate said material inlet port, an upper deck and a lower deck spaced from each other and located between said air intake element and said material inlet port, said upper deck including a screen, defining a plurality of very small apertures which creates a pressure drop from below said upper deck to above said upper deck, a one-way valve mounted on said upper deck and extending downwardly to above said lower deck, enabled by said pressure drop, to move the material from above said upper deck to said lower deck and out through said dry powder outlet element, whereby the air flowing upwardly from below said lower deck to and through said upper deck is prevented from blocking the downflow of material in the apparatus.

2. The apparatus according to claim 1, wherein moist material is provided through said material inlet port to said space defined between said upper deck and the upper end of said housing, said material within said housing, above the upper deck, giving up moisture to the air above said upper deck to the process of fluidization and the heat transfer between said air flowing upwardly being in intimate contact with moisture-laden particles, a first baffle provided on said upper deck proximate where said one-way valve is mounted, so that clockwise flow of material on said upper deck does not move directly through said one-way valve to a lower deck for further drying or cooling.

3. The invention according to claim 1, wherein a second baffle is provided proximate said dry powder outlet element in order to prevent clockwise flowing material on said lower deck flowing from said one-way valve and going directly to said dry powder outlet element.

4. The invention according to claim 1, wherein the upper end of said housing includes a dome for capping said housing, said dome defining said material inlet port.

* * * * *